US005200098A

United States Patent [19]

Dumdum et al.

[11] Patent Number: 5,200,098

[45] Date of Patent: Apr. 6, 1993

[54] CERIUM-CONTAINING LUBRICATING COMPOSITIONS

[75] Inventors: Josefina M. Dumdum, Chino Hills; Paula J. Bosserman, Riverside, both of Calif.

[73] Assignee: Union Oil Company of California, Los Angeles, Calif.

[21] Appl. No.: 257,107

[22] Filed: Oct. 12, 1988

[51] Int. Cl.[5] ..... C10M 125/18

[52] U.S. Cl. ..... 252/18; 252/25; 252/58

[58] Field of Search ..... 252/18, 25, 26, 58; 423/21.1, 21.5

[56] References Cited

U.S. PATENT DOCUMENTS

| | | | |
|---|---|---|---|
| 2,523,892 | 9/1950 | Warf | 423/21.5 |
| 2,564,241 | 8/1951 | Warf | 423/21.5 |
| 3,830,280 | 8/1974 | Larsen | 252/25 |
| 3,853,979 | 12/1974 | McNeese et al. | 423/21.5 |
| 4,507,214 | 3/1985 | Aldorf | 252/18 |
| 4,715,972 | 12/1987 | Pacholke | 252/25 |
| 4,741,893 | 5/1988 | Watanabe et al. | 423/21.5 |
| 4,752,454 | 6/1988 | Pastor et al. | 423/21.1 |

FOREIGN PATENT DOCUMENTS

| | | | |
|---|---|---|---|
| 0581523 | 8/1959 | Canada | 252/25 |

*Primary Examiner*—Margaret Medley
*Attorney, Agent, or Firm*—Arthur E. Oaks; Michael A. Kondzella; Gregory F. Wirzbicki

[57] ABSTRACT

A process for upgrading technical low grade cerium/-fluorine-containing residues having concentrations of silicon and iron above about 1.0 weight percent produces compositions wherein the combined silicon and iron content is less than about 1.0 weight percent. Typically, the cerium content is raised to above about 50 weight percent and sufficient fluorine is present for the fluorine-to-cerium molar ratio to be 3.0 or above. Lubricating compositions comprising a major part of a lubricant and a minor amount of said upgraded cerium/fluorine-containing residue are useful as anti-wear lubricants.

20 Claims, No Drawings

CERIUM-CONTAINING LUBRICATING COMPOSITIONS

BACKGROUND OF THE INVENTION

1. Field of the Invention

This invention relates to a method for upgrading low grade cerium/fluorine-containing residues for use in lubricating oil and grease compositions, and more particularly in lubricating compositions having improved antiwear properties.

2. Description of the Prior Art

Anti-wear additives are chemicals which are added to lubricants to prevent destructive metal-to-metal contact in the lubrication of relatively moving surfaces. Plain mineral oils provide good lubrication and protection against excessive wear just as long as a film of oil is maintained between the relatively moving surfaces. This kind of lubrication, termed "hydrodynamic" is governed by the parameters of the lubricant, principally its viscosity. When the pressures or rubbing speeds between the moving surfaces increase to the point where the film of oil can be squeezed or wiped out, metal-to-metal contact begins to occur, often over a significant portion of the lubricated area. This kind of lubrication, termed "boundary lubrication"is governed largely by parameters of the contacting surfaces such as surface finish, metal shear strength and the coefficient of friction between the metals involved. Unless these parameters can be chosen to meet expected pressures and rubbing speeds, destructive metal-to-metal contact will occur. Such destructive contact manifests itself in various ways including scoring, scuffing, ridging, rippling and, in extreme cases, welding, leading to a catastrophic deformation and/or complete destruction of the lubricated component.

Anti-wear additives, which are added to many lubricants to prevent such conditions from occurring, appear to function by reacting with relatively moving surfaces under boundary lubrication conditions to form an adherent solid lubricant film which has a lower shear strength than that of the metal surfaces. It is thought that this film takes over the task of lubrication when metal-to-metal contact occurs, thus protecting the metal surfaces from damage.

Over the years, the development of satisfactory oil and grease compositions for preventing excessive wear under high pressure, high temperature and/or high speed conditions has received much attention and numerous additives have been proposed to for such service. Such additives are compounds that generally contain lead, sulfur, phosphorus, halogen (principally chlorine), and carboxylate salts, organic phosphates and phosphites. The list also includes chlorinated waxes, sulfurized unsaturated organic compounds, heavy metal sulfides such as lead sulfide and molybdenum disulfide, and antimony thioantimonate.

More recently, it has been shown by Aldorf, in U.S. Pat. No. 4,507,214, the teachings of which are incorporated herein by reference, that rare earth halides, in general and cerium trifluoride, in particular, impart both improved anti-wear and extreme-pressure capabilities to lubricating compositions, particularly at higher temperatures. However, reasonably pure cerium trifluoride is quite expensive. It would be highly desirable if more plentiful, lower grade cerium/fluorine-containing materials could be economically upgraded to a point where they would be satisfactory for use as an anti-wear additive in a lubricating composition. The present invention provides a method for so doing.

SUMMARY OF THE INVENTION

The present invention provides a method of upgrading low grade cerium/fluorine-containing residues contaminated with high silicon and iron contents for use as an anti-wear additive in lubricating compositions. The method comprises digesting said residue one or more times with an aqueous solution of hydrofluoric acid to produce a product having a combined silicon and iron concentration below about 1.0 weight percent. Preferably, the upgraded residue will also have a cerium concentration in excess of about 50 weight percent and sufficient fluorine for the molar ratio of fluorine to cerium to be at least about 3.0. The lubricating compositions comprise a major amount of a lubricating oil or grease and a minor amount of said upgraded residue, said composition being used to provide improved protection against excessive wear in bearings, gears, automotive engine components and other mechanical structures subjected to heavy rolling or sliding loads.

DETAILED DESCRIPTION OF THE INVENTION

The lubricating compositions described herein comprise an oil of lubricating viscosity, an anti-wear effective amount of an upgraded cerium/fluorine-containing residue and, when a grease, one or more thickeners.

The oils which form the major constituent of said lubricating compositions are the oils of lubricating viscosity, said viscosity being from about 35 to about 200 SUS at 210° F. Typical oils meeting this criterion are mineral oils derived from petroleum, shale, gasified coal, bitumen, tar sands, etc., and synthetic oils. Suitable petroleum base oils are derived from distillate lubrication oils having an initial boiling point in the range of about 350° F. to about 475° F., an endpoint in the range of about 500° F. to about 1100° F., and a flashpoint not lower than about 110° F.

Synthetic lubricating oils useful herein are those derived from a product of chemical synthesis, i.e., manufactured oils. Typical examples of such materials include polyglycol fluids such as polyalkylene glycols, polyorganophosphates, polyphenyl esters, synthetic hydrocarbons, various esters of organic acids with alcohols and silicones, which are a silicon-oxygen polymeric chain to which are attached hydrocarbon branches composed of either alkyl or phenyl groups.

The lubricating oil typically comprises at least about 50 weight percent, preferably at least about 60 weight percent and more preferably at least about 70 weight percent of the lubricating composition. To form a grease, the lubricating oil is conveniently thickened to a grease consistency with an oil thickener. Generally two types of thickeners are used—soaps and/or non-soaps.

A soap-base thickening agent as used herein is defined as being one or more of the metal soaps of saponifiable fats, oils or fatty acids which are capable of providing a stable gel structure to lubricating base oils. Typical fatty materials used herein are derived from those having carbon chains from about 10 to about 40 atoms ($C_{10}$ to $C_{40}$), preferably from about 15 to about 30 atoms, in length. Other saponifiable materials used in the manufacture of lubricating greases include distilled rosin oil, naphthenic acids, sulfonic acids, montan wax and wool wax.

The term soap-base is intended to include conventional single base metal soaps, mixed base soaps and complex soaps as follows:

CONVENTIONAL SINGLE BASE METAL SOAPS

Soaps of aluminum, barium, calcium, lead, lithium, lead, magnesium, sodium or strontium including stearates, oleates, palmitates, hydroxy stearates, acetates, sulfonates, azelates, acrylates and benzoates.

MIXED BASE SOAPS

Soaps of two or more metals in mixtures of varying amounts. Typical mixed base soaps include the stearates, oleates, palmitates, hydroxystearates, acetates, acrylates, azelates, benzoates and sulfonates of aluminum-calcium, aluminum-lead, aluminum-lithium, aluminum-sodium, aluminum-zinc, barium-aluminum, barium-calcium, barium-lithium, calcium-magnesium, calcium-sodium, lithium-aluminum, lithium-aluminum-lead, lithium-aluminum-zinc, lithium-calcium, lithium-potassium, lithium-sodium, sodium-barium, sodium-calcium, sodium-lead, sodium-lithium and sodium-zinc.

COMPLEX SOAPS

Soaps having dissimilar acid radicals associated with a single metal ion, sometimes mixed with metallic salts and/or organic polar compounds and metal soaps of polycarboxylic acids. Examples include aluminum benzoate-stearate-hydroxide (aluminum complex), barium acetate-stearate (barium complex), calcium acetate-stearate (calcium complex) and dilithium azelate mixed with lithium borate (lithium complex).

Non-soap thickeners include all those thickeners that are not prepared by the process of saponification. Such materials include one or more thickeners chosen from organo-clays such as bentonite, kaolinite, montmorillonite, monazite and hectorite, polymers, polyurea, silica gel, carbon black, dyes and pigments.

In use, the oil thickener is generally mixed with the lubricating oil in an amount sufficient to impart a grease-like consistency thereto, generally in a concentration between about 0.1 and about 30 weight percent, preferably between about 3 and 20 weight percent.

The anti-wear additive-containing lubricating compositions disclosed herein comprise an effective amount of a cerium/fluorine composition prepared by the purification process of the present invention.

Cerium, like all of "lanthanide" or "rare earth"elements, occurs in nature as a complex mixture with most, if not all, of the other members of the series. The cerium/fluorine-containing composition of the present invention is obtained from the residues produced by a process currently used for the separation and extraction of various "rare earth" constituents from a fluorocarbonate ore known as bastnasite. Typically about 30 percent of the cerium originally present in the ore remains behind in these residues which are sold as "technical grade cerium fluoride," and this is the starting material for the process of this invention. As produced, the bulk residue has a cerium concentration of between about 40 and about 50 weight percent, along with between about 3 and about 10 percent of other lanthanide elements, and a fluorine content of between about 10 and about 15 percent for a fluorine to cerium molar ratio between about 2 and 2.2.

The major impurities are between about 5 and about 10 percent barium, strontium and calcium sulfates combined, with the combined concentration of silicon and iron typically being about 1 weight percent, or less, of the residue. While the fluorine content normally is not high enough for all of the cerium in this material to be present as the trifluoride ($CeF_3$), still, as shown in U.S. Pat. No. 4,507,214, such a material can be used as a lubricant additive. However, many lots of this material have silica and iron contents above about 1.0 weight percent. When this is the case, it is found that these lots, when incorporated into an anti-wear lubricating composition actually cause, rather than prevent, excessive wear, and the combined silica plus iron content must be reduced to below about 1 weight percent, preferably to below about 0.75 weight percent, before they are satisfactory for such use.

In the present invention, the combined silicon and iron content of these cerium-containing residues is reduced to a level suitable for lubricant use by digesting a water slurry of the residue with between 0.5 and about 2.0 and preferably between about 1.0 and 1.5 cc of a commercial (47 to 53%) hydrofluoric acid solution per gram of dry residue for a time sufficient to reduce the combined silicon plus iron contents to below about 1 weight percent of the residue. The digestion temperature is not critical and the reaction proceeds at a reasonable rate even at "room" temperatures, i.e., those under about 100° F. In view of the extreme toxicity of hydrogen fluoride, along with the other problems associated with working with toxic fluorides, great care must be taken to prevent HF gas, silicon tetrafluoride, and other gaseous and solid fluoride-containing products of the digestion from escaping into the surrounding environment. Consequently, room temperature digestion is preferred, since the measures necessary to do this are considerably less stringent than would be the case if higher temperature digestion operations were employed. At a temperature of about 80° F., the operation will typically take between about 20 and about 30 hours. With other residue materials, longer or shorter digestion times may be used, depending, of course, on the amount and nature of the silicon and iron contaminants which must be removed.

After digestion is completed, the acid solution is decanted and the residue water washed. At this time, it is found that not only has the combined silicon and iron concentration usually been reduced to below about 1 percent, preferably to below about 0.75 percent, but that the fluorine content in the dried material has been raised to a level wherein the fluorine to cerium molar ratio is at least about 3.0 and, preferably, greater. Further, enough of the "other" material found in these residues has usually been removed to raise the cerium content therein, often to above about 50 weight percent. Consequently, the treated material is now substantially purer than the low-grade cerium/fluorine-containing "technical grade" residues from which it was derived. Where the amount of contaminant material is very high, a second, or possibly even a third digestion with fresh acid solution may be required to achieve this degree of improvement.

The cerium/fluorine-containing lubricants of the present invention comprise a mixture comprising a major amount of a lubricating oil or grease admixed with a minor amount of an upgraded cerium/fluorine-containing residue, prepared as described hereinabove, as an anti-wear additive. The minor amount typically ranges from about 0.1 to about 20 weight percent and, preferably, from about 1 to about 10 weight percent.

If desired, the additive may be employed in conjunction with other additives commonly employed in lubricating oils and greases. Thus there may be added to the lubricating oils and greases of this invention detergents, antioxidants, rust inhibitors, tackifiers, emulsion agents and suspension stabilizers, as well as other anti-wear and extreme pressure additives. The only requirement to adding such additives is that they be compatible with the upgraded cerium residue and other basic constituents of the lubricating composition.

The upgraded cerium/fluorine-containing residue of this invention may also be incorporated into lubricating pastes, commonly known as "pipe dopes", which are used to protect threaded components such as pipes, couplings, high-strength nuts and bolts and similar structures from scuffing, galling and possible seizure during assembly and disassembly operations. They also act to fill in any irregularities in the threads so that the joint will withstand high pressures better.

The present invention is further illustrated by the following examples which are illustrative and not intended as limiting the scope of the invention, which is defined in the claims.

EXAMPLE 1

A water slurry of 30 grams of "technical grade"-cerium fluoride, previously ground to about a 3 micron particle size and containing a combined silicon and iron content of 2.43 weight percent was digested with 30 cc of a 48% solution of hydrogen fluoride for about 24 hours at room temperature. At the conclusion of this time, the acid solution was decanted from the solid material, washed with water and air dried. Analytical results for the original and treated materials are shown in table 1 below:

TABLE 1

| Component | Untreated (wt %) | HF Treated (wt. %) |
|---|---|---|
| Cerium | 47 | 53 |
| Fluorine | 15 | 24 |
| Silicon | 1.85 | 0.26 |
| Iron | 0.58 | 0.31 |
| Barium | 6.82 | 7.33 |
| Strontium | 1.60 | 1.73 |
| "Other" | 27.15 | 13.37 |

The color of the material went from a light tan to an off-white color closely resembling that of pure cerium trifluoride. This is attributed to the reduction in the iron concentration. Also, note that, while the combined silicon and iron concentrations decreased to well below 1 percent of the dried residue, the fluorine level went up. The fluorine-to-cerium molar ratio rose from an initial value of 2.33 to 3.35, which is more than enough for all of the cerium in the upgraded cerium/fluorine-containing residue to be present as the trifluoride salt, $CeF_3$

EXAMPLE 2

The upgraded cerium/fluorine-containing material of Example 1 was tested for anti-wear capabilities in a lubricating composition comprising about 3 weight percent additive in a grease containing about 7 weight percent lithium 12-hydroxy stearate and 93 weight percent SAE 40 viscosity oil (70 SUS at 70° F.). For comparison purposes, the above blend was tested against the base grease alone and grease blends containing 3 weight percent pure cerium trifluoride, the untreated technical grade cerium residue used in Example 1 and molybdenum disulfide.

The anti-wear properties were determined by the 3-ball Wear Test (ASTM D-2296) which measures the average diameter, in millimeters, of the scars produced on 3 greased stationary balls by another ball which is rotated against them at 1200 rpm, at 167° F., under a 40 Kg load for 1 hour. The size of the scars produced by such rotation is indicative of the anti-wear capabilities of the tested material with smaller scar diameters indicating that the composition tested has relatively better improved anti-wear properties.

The results obtained are given in Table 2 below:

TABLE 2

| Sample tested | Four-ball Wear Test Scar Diameter (mm) |
|---|---|
| Base grease | 0.73 |
| Base grease + pure $CeF_3$ | 0.64 |
| Base grease + upgraded residue | 0.68 |
| Base grease + untreated residue | 0.83 |
| Base grease + $MoS_2$ | 0.65 |

These data show that the upgraded cerium/fluorine-containing residue of the present invention, when added to a conventional lubricating grease, achieves a level of anti-wear protection (0.68 mm scar diameter) which is essentially identical to that achieved with either pure cerium trifluoride or molybdenum disulfide, when tested at the same concentration and under the same test conditions. This is true even though the particular lot of upgraded material used only contained about 75–80 weight percent of combined cerium and fluorine. Note also that adding the untreated "technical grade" cerium fluoride produced scarring which was not only worse than that observed with the other additive-containing grease samples but worse even than that with the base grease alone.

Obviously many modifications and variations of this invention, as hereinabove set forth, may be made without departing from the spirit and scope thereof, and therefore only such limitations should be imposed as are indicated in the following claims. All embodiments which come within the scope and equivalency of the claims are, therefore, intended to be embraced therein.

We claim:

1. A process for upgrading cerium/fluorine-containing compositions contaminated with silicon and iron in a total concentration at or above about 1.0 weight percent comprising digesting said composition with an aqueous solution of hydrofluoric acid for a time sufficient to reduce the combined silicon and iron contents to below about 1.0 weight percent, with said upgraded composition having a combined iron and silicon content of at least about 0.1 weight percent.

2. The process of claim 1 wherein said digested composition has a cerium concentration above about 50 weight percent and a fluorine content equal to at least about 3 moles of fluorine for every mole of cerium present, and the combined silicon and iron content is below about 0.75 weight percent.

3. The process of claim 1 wherein said aqueous acid solution comprises between about 47 and about 53 percent by weight of hydrogen fluoride with between 0.5 and 2.0 grams of said acid solution being used per gram of dry composition being treated.

4. The process of claim 1 wherein the combined content of iron and silicon in the upgraded composition is at least about 0.57 weight percent.

5. A method for providing an anti-wear lubrication composition comprising the steps of:

a) digesting a cerium/fluorine-containing composition contaminated with high silicon and iron contents with an aqueous solution of hydrofluoric acid for a time sufficient to reduce the combined silicon and iron contents to below about 1.0 weight percent and to raise the fluorine-to-cerium molar ratio to about 3.0 or above, with said upgraded composition having a combined iron and silicon content of at least about 0.1 weight percent; and b) forming said anti-wear lubricating composition by blending a homogeneous mixture of:

1) at least about 80 weight percent of a lubricant; and 2) from about 0.1 to about 20 weight percent of the digested cerium/fluorine-containing composition of step a).

6. The method of claim 5 wherein said lubricant is an oil of lubricating viscosity.

7. The method of claim 5 wherein said lubricant comprises an oil of lubricating viscosity and one or more oil thickeners.

8. The method of claim 7 where said oil thicknener is selected from the group consisting of single base metal soaps, mixed base soaps, complex soaps, organo clay, polymers, polyurea, silica gel, carbon black, dyes and mixtures thereof.

9. The method of claim 5 wherein said digested composition has a cerium content above about 50 weight percent and the combined silicon and iron content is below about 0.75 weight percent.

10. The method of claim 5 wherein said aqueous hydrofluoric acid solution comprises between about 47 and about 53 percent by weight of hydrogen fluoride, said solution being present in an amount between 0.5 and 2.0 grams of acid solution per gram of dry material being digested.

11. The method of claim 5 wherein a substantial percentage of the cerium in the digested product of step a) is present as cerium trifluoride.

12. The method of claim 5 wherein essentially all of the cerium in the digested product of step a) is present as cerium trifluoride.

13. The method of claim 5 wherein the combined content of iron and silicon in the upgraded composition is at least about 0.57 weight percent.

14. The method of claim 13 wherein said lubricant is an oil of lubricating viscosity.

15. The method of claim 13 wherein said lubricant comprises an oil of lubricating viscosity and one or more oil thickeners.

16. The method of claim 15 where said oil thickener is selected from the group consisting of single base metal soaps, mixed base soaps, complex soaps, organo clay, polymers, polyurea, silica gel, carbon black, dyes and mixtures thereof.

17. The method of claim 13 wherein said aqueous hydrofluoric acid solution comprises between about 47 and about 53 percent by weight of hydrogen fluoride, said solution is present in an amount between 0.5 and 2.0 grams of acid solution per gram of dry material which is digested.

18. A process for upgrading cerium/fluorine-containing residues from the processing of bastnasite, said residues being contaminated with silicon and iron in a total concentration at or about 1.0 weight percent comprising digesting said composition with an aqueous solution of hydrofluoric acid for a time sufficient to reduce the combined silicon and iron contents to below about 1.0 weight percent, with said upgraded residue having a combined iron and silicon content of at least about 0.1 weight percent.

19. The process of claim 18 wherein said digested composition has a cerium concentration above about 50 weight percent and a fluorine content equal to at least about 3 moles of fluorine for every mole of cerium present, and the combined silicon and iron content is below about 0.75 weight percent.

20. The process of claim 18 wherein the combined content of iron and silicon in the upgraded composition is at least about 0.57 weight percent.

* * * * *

UNITED STATES PATENT AND TRADEMARK OFFICE

CERTIFICATE OF CORRECTION

PATENT NO. : 5,200,098

DATED : April 6, 1993

INVENTOR(S) : Josefina M. Dumdum and Paula J. Bosserman

It is certified that error appears in the above-identified patent and that said Letters Patent is hereby corrected as shown below:

Column 8, claim 18, line 29, replace "about" with -- above --.

Signed and Sealed this

Third Day of May, 1994

Bruce Lehman

*Attest:*

BRUCE LEHMAN

*Attesting Officer*

*Commissioner of Patents and Trademarks*